United States Patent [19]

Amboss

[11] Patent Number: 4,553,064

[45] Date of Patent: Nov. 12, 1985

[54] DUAL-MODE ELECTRON GUN WITH IMPROVED SHADOW GRID ARRANGEMENT

[75] Inventor: Kurt Amboss, Pacific Palisades, Calif.

[73] Assignee: Hughes Aircraft Company, El Segundo, Calif.

[21] Appl. No.: 527,724

[22] Filed: Aug. 30, 1983

[51] Int. Cl.[4] ..... H01J 29/48

[52] U.S. Cl. ..... 313/448; 313/449; 313/460; 313/348; 313/349; 315/3.5; 315/3.6

[58] Field of Search ..... 313/449, 448, 460, 348, 313/349; 315/3.5, 3.6

[56] References Cited

U.S. PATENT DOCUMENTS

| | | | |
|---|---|---|---|
| 3,812,395 | 5/1974 | Scott | 315/3.6 |
| 3,818,260 | 6/1974 | Elfe, Jr. et al. | 315/3.5 |
| 3,843,902 | 10/1974 | Miram et al. | 313/348 |
| 3,852,633 | 12/1974 | Hunter | 315/3.5 |
| 3,859,552 | 1/1975 | Hechtel | 313/449 |
| 3,967,150 | 6/1976 | Lien et al. | 313/348 |
| 4,023,061 | 5/1977 | Berwick et al. | 313/349 |
| 4,321,505 | 3/1982 | Miram et al. | 315/3.5 |
| 4,471,267 | 9/1984 | Amboss | 313/348 |

OTHER PUBLICATIONS

Hechtel et al., "A Dual Mode Electron Gun Having Non-Intercepting Grids", 1973, *IEDM Technical* Digest, pp. 171–174.

*Primary Examiner*—William F. Smith

*Attorney, Agent, or Firm*—Paul M. Coble; A. W. Karambelas

[57] ABSTRACT

A dual-mode electron gun for a traveling-wave tube is disclosed which selectively generates an electron beam of two different cross-sectional areas. The electron gun includes radially inner and annular control grids as well as a shadow grid disposed between the cathode and the control grids along the electron beam path. The shadow grid is provided with a suppressor ring which precludes electron emission from an annular portion of the cathode immediately radially outwardly of the cathode region over which the inner control grid projects, thereby eliminating generation of a spurious beam portion radially outwardly from the desired smaller cross-section beam.

4 Claims, 8 Drawing Figures

DUAL-MODE ELECTRON GUN WITH IMPROVED SHADOW GRID ARRANGEMENT

BACKGROUND OF THE INVENTION

1. Field of the Invention

This invention relates to electron beam-generating devices, and more particularly, it relates to a dual-mode electron gun especially suitable for traveling-wave tubes.

2. Description of the Prior Art

Dual-mode traveling-wave tubes have been developed in which a single tube is designed to operate selectively in either a low power mode or a high power mode. The power level of a traveling-wave tube is a function of both the current and voltage of the electron beam used to interact with the propagating electromagnetic waves. Hence, in order to achieve dual-mode operation, the beam current is selectively switched between different levels in a manner sufficiently compatible with other tube parameters such that desired operation in both modes may be obtained.

A classic form of dual-mode electron gun is described in U.S. Pat. No. 3,859,552 to Richard Hechtel, as well as in the Hechtel and Hamak paper, "A Dual Mode Electron Gun Having Non-Intercepting Grids", 1973 *IEDM Technical Digest,* pp. 171–174. In this electron gun, a beam of large cross-sectional area is emitted from the entire cathode surface in the high power mode, while a beam of reduced cross-sectional area, but of the same current density, is emitted from the central portion of the cathode surface in the low power mode. The foregoing is achieved by splitting the control grid of the gun into an inner circular grid and an outer annular grid. In order to generate the large cross-section beam, a positive voltage with respect to the cathode is applied to both control grids. The reduced cross-section beam is generated by making the voltage on the outer control grid negative with respect to the cathode. In order to eliminate current interception by the control grids, a shadow grid having the same geometry as the control grids and maintained at cathode potential is disposed between the cathode and the control grids.

During operation of the aforementioned electron gun in generating the reduced cross-section beam, an acceptable value of negative voltage applied to the outer control grid is unable to prevent emission from an annular region of the cathode immediately radially outwardly of the cathode region over which the inner control grid projects. Thus, a spurious annular beam portion is generated radially outwardly of the desired low mode beam. In addition, the electric field between the outer and inner control grids deflects the spurious beam portion radially inwardly. The spurious electrons eventually are intercepted either by downstream electrodes of the electron gun or by the slow-wave circuit of the traveling-wave tube in which the gun is utilized, thereby wasting beam current and reducing the operating efficiency of the tube.

SUMMARY OF THE INVENTION

It is an object of the present invention to provide a dual-mode electron gun which selectively generates an electron beam of two different cross-sectional areas and in which electron interception by downstream electrodes is minimized during operation with the smaller cross-section beam.

It is a further object of the invention to provide a dual-mode electron gun suitable for use with a traveling-wave tube which achieves increased operating efficiency, reduced heat dissipation, and higher power operation in the low power mode than with otherwise comparable dual-mode electron guns of the prior art.

In a dual-mode electron gun according to the invention, a shadow grid is employed having a ring of electrically conductive material disposed radially between inner and outer grid portions. The inner circumference of the ring is substantially aligned with the circumference of the radially inner control grid along a direction normal to the cathode emissive surface, while the outer circumference of the ring is substantially aligned with the inner circumference of the annular control grid along a direction normal to the cathode emissive surface. Electron emission is precluded from the portion of the cathode surface over which the ring projects, and no spurious electron beam portion is generated radially outwardly from the desired low mode beam.

Additional objects, advantages, and characteristic features of the present invention will become readily apparent from the following detailed description of a preferred embodiment of the invention when considered in conjunction with the accompanying drawings.

DETAILED DESCRIPTION OF THE INVENTION

In order to more fully appreciate the advantages of the present invention, it is helpful to first discuss characteristics of the structure and operation of the prior art dual-mode electron gun mentioned above and illustrated in FIGS. 1–5.

Figure 1:
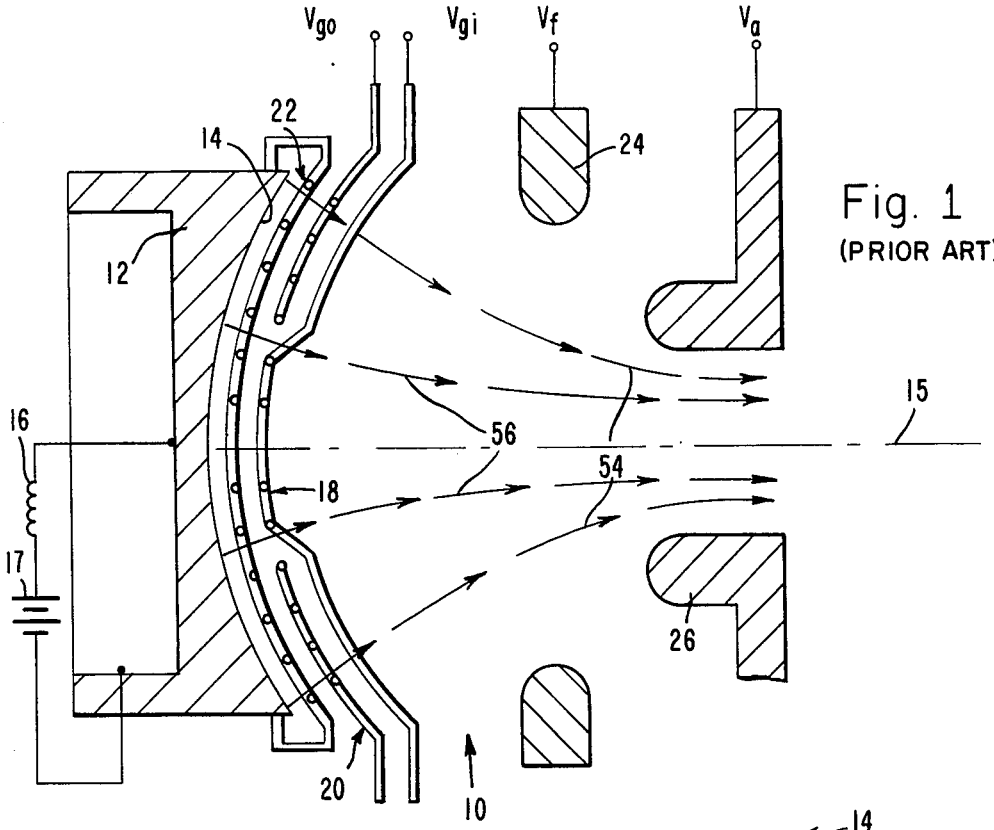
Fig. 1 (PRIOR ART)
FIG. 1 is a longitudinal sectional view illustrating a dual-mode electron gun according to the prior art.

As shown in FIG. 1, prior art dual-mode electron gun 10 is provided with an electrically heated cathode 12 having a concave electron emissive surface 14 defining a figure of revolution about a predetermined axis 15 along which the generated electron beam travels. The cathode 12 may be heated by means of a filament 16 energized from a source of potential 17. A grid arrangement to control the emission of electrons from the cathode surface 14 includes a radially inner control grid 18 spaced from the cathode surface 14 along the axis 15. An annular control grid 20 is coaxially disposed about the axis 15 radially outwardly from the control grid 18, and a shadow grid 22 is coaxially disposed about the axis 15 between the cathode surface 14 and the control grids 18 and 20. Coaxially disposed about the axis 15 downstream from the control grids 18 and 20 are annular focusing electrode 24 and accelerating anode 26. Appropriate operating potentials $V_{gi}$, $V_{go}$, $V_f$ and $V_a$ are applied to inner control grid 18, outer control grid 20, focusing electrode 24 and accelerating anode 26, respectively. The shadow grid 22 is electrically connected directly to the cathode 12.

Figure 3:
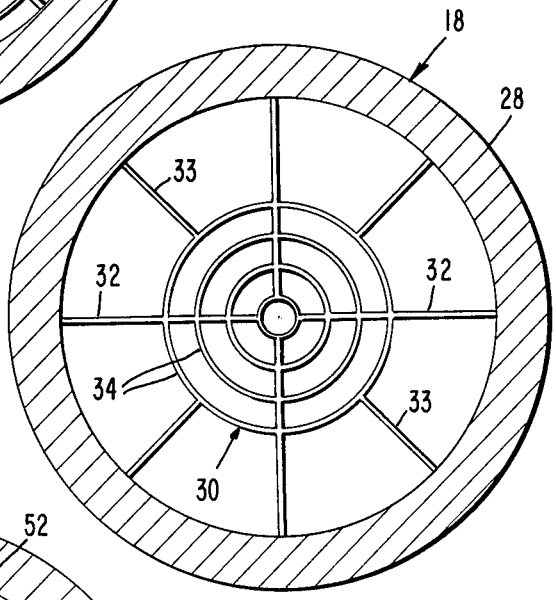
Fig. 3. (PRIOR ART)

As shown in FIG. 3, radially inner control grid 18 has a peripheral annular mounting member 28 and a central circular grid structure 30 supported by radial web portions 32 and 33 which extend inwardly from the mounting member 28. Central grid structure 30 includes a plurality of annular web portions 34 at different radial locations. Radial web portions 32 extend all the way to the innermost annular web portion 34, while radial web portions 33 extend only to the outermost annular web portion 34. The central grid structure 30 is disposed along a concave surface substantially conforming to the cathode surface 14 and projects over the central portion only of the cathode surface 14.

Figure 2:
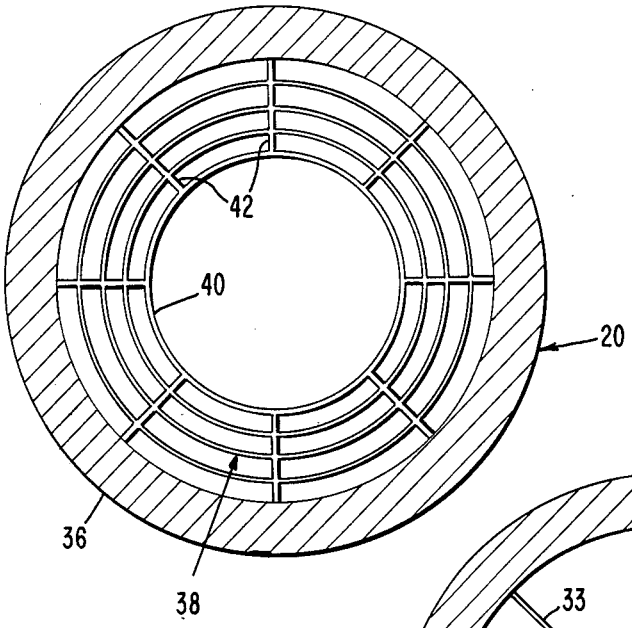
Fig. 2. (PRIOR ART)
FIGS. 2, 3 and 4 are cross-sectional views illustrating the outer control grid, the inner control grid, and the shadow grid, respectively, of the electron gun of FIG. 1.

As shown in FIG. 2, annular control grid 20 has a peripheral annular mounting member 36 and an annular grid structure 38. Annular grid structure 38 includes a plurality of annular web portions 40 supported by radial web portions 42 extending inwardly from the mounting member 36. The diameter of the innermost annular web portion 40 of the annular control grid 20 is larger than the diameter of the outermost annular web portion 34 of the inner control grid 18. As may be seen from FIG. 1, the annular control grid 20 is disposed along an extension of the concave surface along which the inner control grid 18 is located so that the annular grid structure 38 projects over an annular peripheral portion only of the cathode surface 14.

Figure 4:
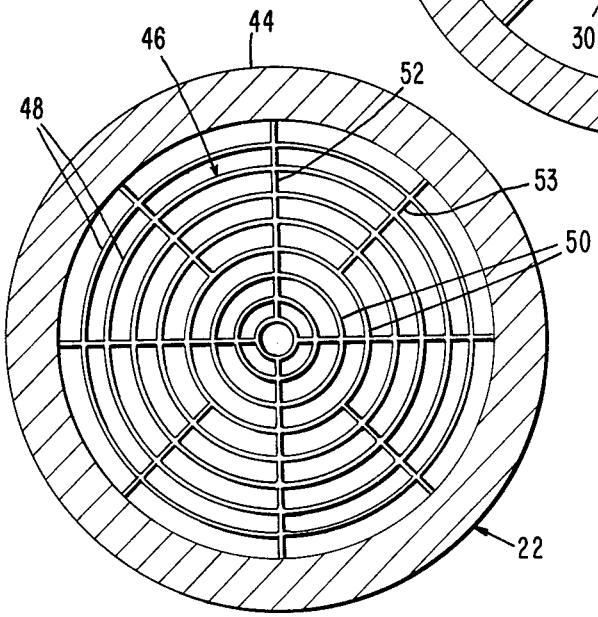
Fig. 4. (PRIOR ART)

As shown in FIG. 4, shadow grid 22 has a peripheral annular mounting member 44 and a grid structure 46 within the member 44. The grid structure 46 is substantially identical to the combined grid structures 30 and 38 of the control grids 18 and 20, respectively. More specifically, grid structure 46 has a plurality of annular web portions 48 aligned with respective annular web portions 40 of the annular grid structure 38, a plurality of annular web portions 50 aligned with respective annular web portions 34 of the central grid structure 30, a plurality of radial web portions 52 aligned with radial web portions 32 of the inner control grid 18, and a plurality of shorter radial web portions 53 aligned with radial web portions 33 of the grid 18. The grid structure 46 defines a figure of revolution about the electron beam axis 15 along a surface substantially conforming to the cathode surface 14. Since the individual web portions of the shadow grid structure 46 are aligned with respective individual web portions of the control grid structures 30 and 38, the shadow grid 22 serves to protect the control grids 18 and 20 from bombardment by beam electrons.

To operate the electron gun of FIGS. 1–4 in the high power mode, control grids 18 and 20 are both electrically biased positively with respect to the cathode 12. Central grid structure 30 and annular grid structure 38 both attract electrons from the cathode 12 causing the cathode 12 to emit electrons over substantially its entire emissive surface 14 and form a beam of relatively large cross-sectional area shown generally within dashed lines 54.

To operate the electron gun of FIGS. 1–4 in the low power mode, the radially inner control grid 18 is electrically biased positively with respect to the cathode 12, and the annular control grid 20 is electrically biased negatively with respect to the cathode 12. Thus, electrons are attracted from the central area of the cathode surface 14 over which the central grid structure 30 projects, while electron emission is inhibited from the outer annular region of the cathode surface 14 over which the annular grid structure 38 projects. As a result, a beam of smaller cross-sectional area, shown generally within dashed lines 56, is generated.

Figure 5:
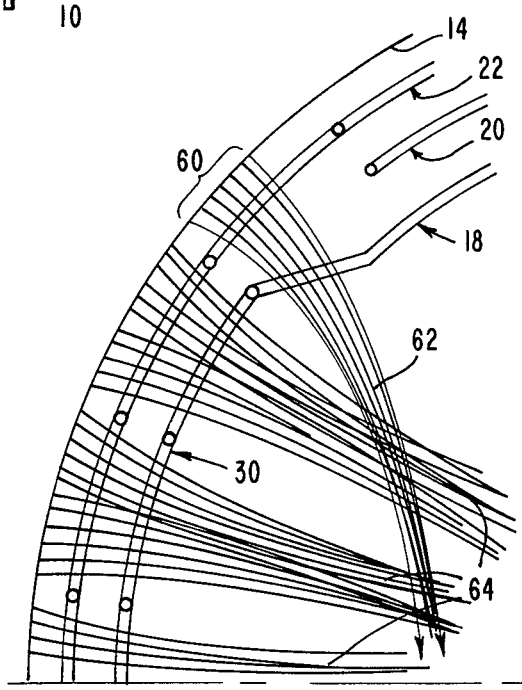
Fig. 5. (PRIOR ART)
FIG. 5 is a diagramatic view of a portion of the electron gun of FIG. 1 showing the generation of the aforementioned spurious beam portion.

However, as may be seen from FIG. 5, in actual operation of the prior art electron gun of FIGS. 1–4, the idealized smaller cross-section beam 56 is not realized. Although the negative potential on the annular control grid 20 precludes electron emission from the outer annular portion of the cathode surface 14 over which the grid 20 projects, it does not prevent electron emission from an annular region 60 of the cathode surface 14 located immediately radially outwardly of the portion of surface 14 over which the inner grid structure 30 projects. Thus, a spurious annular electron beam portion 62 is generated radially outwardly of the desired electron beam 64. The electric field between the negative annular grid 20 and the positive radially inner grid structure 30 is such as to deflect electrons in the spurious beam portion 62 radially inwardly. As a result, spurious electrons in the beam portion 62, which typically amounts to about 3% of the current of the desired beam 64, are intercepted either by downstream electrodes of the electron gun or by the slow-wave circuit of the traveling-wave tube in which the gun is utilized, thereby wasting beam current and reducing the operating efficiency of the tube.

Figure 6:
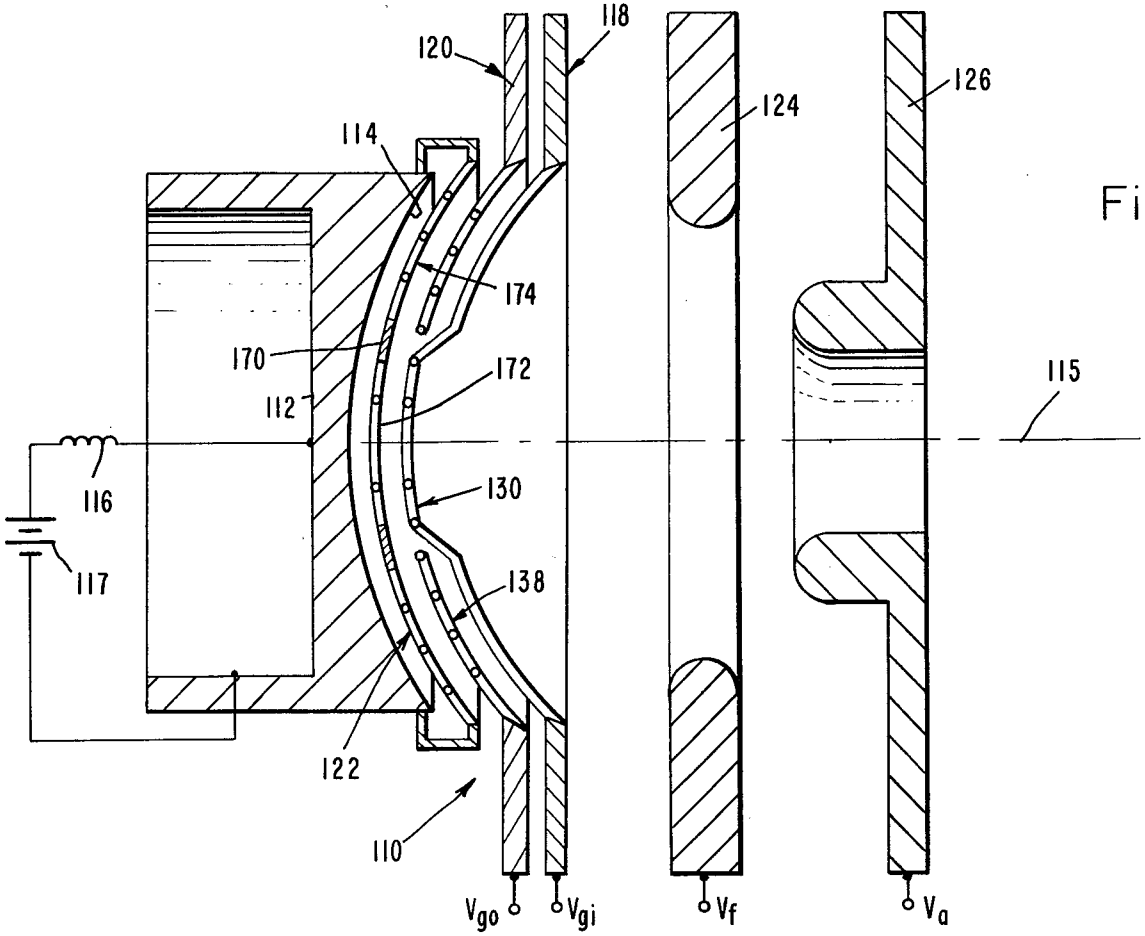
FIG. 6 is a longitudinal sectional view illustrating a dual-mode electron gun according to the present invention.
Figure 7:
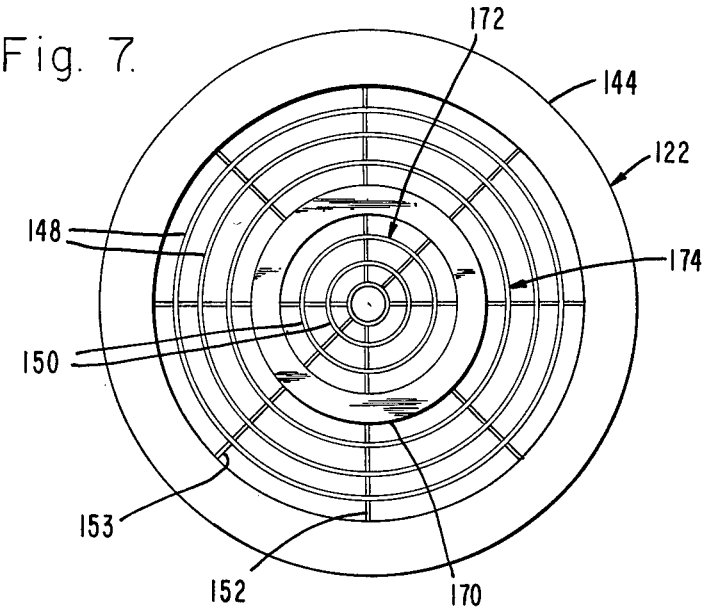
FIG. 7 is a cross-sectional view showing the shadow grid of the electron gun of FIG. 6.
Figure 8:
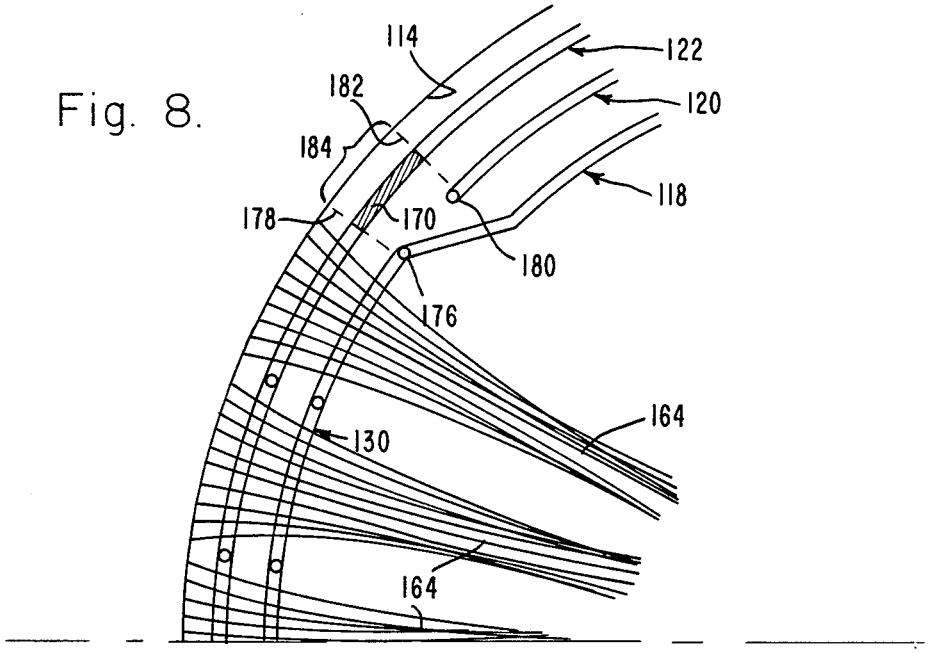
FIG. 8 is a diagrammatic view of a portion of the electron gun of FIG. 6 illustrating operation of an electron gun according to the invention to eliminate generation of the aforementioned spurious beam portion.

A dual-mode electron gun according to the present invention, which eliminates the aforementioned spurious electron beam portion and its undesirable consequences, is illustrated in FIGS. 6–8. Components in the electron gun of FIGS. 6–8 which are the same as or which generally functionally correspond to respective components in the electron gun of FIGS. 1–5 are designated by the same second and third reference numeral digits as their corresponding components in FIGS. 1–5, along with the addition of a prefix numeral "1".

In a dual-mode electron gun according to the invention, shadow grid 122 is constructed with an enlarged ring 170 of electrically conductive material disposed between radially inner grid portion 172 and radially outer grid portion 174. The ring 170, as well as the grid structures of the shadow grid 122 and the control grids 118 and 120 may be made of copper, for example. The inner circumference of the ring 170 is substantially aligned with the circumference of grid structure 130 of radially inner control grid 118 along a direction normal to the cathode surface 114, while the outer circumference of the ring 170 is substantially aligned with the inner circumference of annular grid structure 138 of the annular control grid 120 along a direction normal to the cathode surface 114. More specifically, as shown in FIG. 8, the inner circumference of electrically conductive ring 170 is aligned with the inner circumference of the outermost annular web portion 176 of grid structure 130 along direction 178 normal to the cathode surface 114. The outer circumference of ring 170 is aligned with the outer circumference of the innermost annular web portion 180 of the annular control grid 120 along direction 182 normal to the cathode surface 114.

In the operation of the electron gun of FIGS. 6–8 to generate a low power beam, i.e., a beam of reduced cross-section, a positive voltage (for example, +200 volts) with respect to the cathode 112 is applied to the radially inner control grid 118, while a negative voltage (for example, −200 volts) with respect to the cathode is applied to the annular control grid 120. The electrically conductive ring 170 shields the annular portion 184 of the cathode surface 114 over which the ring 170 projects (i.e., the surface portion bounded by normals 178 and 182) from the potential of the annular control grid 120. As a result, electron emission from the cathode surface portion 184 is precluded. No spurious electron beam portion is generated radially outwardly of the desired low mode beam 164, and electron interception by downstream electrodes in the electron gun and in the slow-wave circuit of the associated traveling-wave tube is minimized. This enables the traveling-wave tube to achieve increased operating efficiency, reduced heat dissipation, and higher power operation in the low power mode than with the prior art electron gun of FIGS. 1–5.

In the operation of the electron gun of FIGS. 6–8 to generate a high power beam, i.e., a beam of large cross-sectional area, a positive voltage (for example, +200 volts) with respect to the cathode 112 is applied to both control grids 118 and 120. During this mode of operation the ring 170 will also preclude emission from annular region 184 of the cathode surface 114. Thus, there will be a small annular gap in the generated high power beam. Although this gap has little effect on the performance of the electron gun, its width can be minimized by making the radial extent of the ring 170 (and, correspondingly, the radial separation between the outermost annular web portion 176 of the inner control grid 118 and the innermost annular web portion 180 of the annular control grid 120) as small as possible without allowing voltage breakdown to occur between the grids 118 and 120 when the maximum potential difference is applied between the grids 118 and 120.

As a specific example for illustrative purposes, in a preferred embodiment of the invention the radial extent of the ring 170 may be about 25 mils, and the radial extent of the annular web portions 150, 148, 140, and 134 may be about 3 to 4 mils. Thus, the radial separation between the annular control grid 120 and the radially inner control grid 118 (i.e., the separation between the annular web portions 180 and 176) may be as small as about 17 mils. This compares with a radial separation of 30 to 40 mils between the inner and annular control grids 18 and 20, respectively, in a corresponding prior art electron gun according to FIGS. 1–5.

Since the aforementioned radial separation of 30 to 40 mils is typically used between adjacent ones of the annular web portions 148 and 150 in the electron gun of FIGS. 6–8, it may be seen that the radial extent of the ring 170 is less than the smallest radial separation between adjacent ones of such annular web portions. At the same time, the ring 170 has a radial extent at least five times greater than the radial extent of the annular web portions 148 and 150.

Although the present invention has been shown and described with reference to a particular embodiment, nevertheless, various changes and modifications which are obvious to a person skilled in the art to which the invention pertains are deemed to lie within the spirit, scope, and contemplation of the invention.

What is claimed is:

1. A dual-mode electron gun comprising:

a cathode having an electron emissive surface defining a figure of revolution about a predetermined axis; a radially inner control grid spaced from said electron emissive surface along said axis and defining a figure of revolution about said axis along a surface substantially conforming to said electron emissive surface, said radially inner control grid projecting over the central portion of said electron emissive surface; an annular control grid coaxially disposed about said axis radially outwardly from said radially inner control grid along an extension of said surface substantially conforming to said electron emissive surface, said annular control grid projecting over an annular peripheral portion of said electron emissive surface; and a shadow grid coaxially disposed along said axis between said electron emissive surface and said radially inner and said annular control grids and defining a figure of revolution about said axis along a surface substantially conforming to said electron emissive surface, said shadow grid being substantially aligned with said radially inner and said annular control grids, wherein the improvement comprises:

said shadow grid having a ring of electrically conductive material disposed radially between inner and outer grid portions of said shadow grid, said ring having an inner circumference substantially aligned with the circumference of said radially inner control grid along a direction normal to said electron emissive surface and having an outer circumference substantially aligned with the inner circumference of said annular control grid along a direction normal to said electron emissive surface.

2. A dual-mode electron gun according to claim 1 wherein said radially inner control grid defines a first annular web portion at its outer radially extremity, said annular control grid defines a second annular web portion at its inner radial extremity, the inner circumference of said electrically conductive ring being substantially aligned with the inner circumference of said first annular web portion along a direction normal to said electron emissive surface, and the outer circumference of said electrically conductive ring being substantially aligned with the outer circumference of said second annular web portion along a direction normal to said electron emissive surface.

3. A dual-mode electron gun according to claim 1 wherein said radially inner and said annular control grids and said shadow grid each defines at least one annular web portion, the radial extent of said electrically conductive ring being at least five times greater than that of each said web portion.

4. A dual-mode electron gun according to claim 1 wherein said radially inner control grid and said shadow grid each defines a plurality of annular web portions at different radial locations, the radial extent of said electrically conductive ring being less than the smallest radial separation between adjacent ones of said annular web portions.

* * * * *